US007566312B2

(12) United States Patent
Tanizawa et al.

(10) Patent No.: US 7,566,312 B2
(45) Date of Patent: Jul. 28, 2009

(54) MASSAGE PROGRAM CONTROL METHOD, MASSAGE MACHINE USING THE METHOD, AND CONTROLLER FOR THE MASSAGE MACHINE

(75) Inventors: Takayoshi Tanizawa, Kanzaki-gun (JP); Masamichi Miyaguchi, Hikone (JP); Fumihiro Nishio, Hikone (JP); Daisuke Tsukada, Hikone (JP); Yuichi Nishibori, Hikone (JP); Motoharu Muto, Osaka (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 106 days.

(21) Appl. No.: 10/553,734

(22) PCT Filed: Apr. 22, 2004

(86) PCT No.: PCT/JP2004/005832

§ 371 (c)(1),
(2), (4) Date: Oct. 20, 2005

(87) PCT Pub. No.: WO2004/093773

PCT Pub. Date: Nov. 4, 2004

(65) Prior Publication Data

US 2006/0217641 A1 Sep. 28, 2006

(30) Foreign Application Priority Data

Apr. 22, 2003 (JP) ..... 2003-117504

(51) Int. Cl.
*A61H 1/00* (2006.01)
*A61H 7/00* (2006.01)
*A61H 19/00* (2006.01)

(52) U.S. Cl. ..... 601/49; 601/46; 601/86; 601/90; 601/93; 601/98; 601/101; 601/150

(58) Field of Classification Search ..... 601/84, 601/86, 87, 90.93, 94, 98, 99, 100–103, 115, 601/134, 15, 46, 49, 51, 52, 56–60, 70, 90, 601/116, 93; 128/905; 600/26, 27, 28; 700/86–88
See application file for complete search history.

(56) References Cited

U.S. PATENT DOCUMENTS 4,422,448 A * 12/1983 Sugai et al. ..... 601/99

(Continued)

FOREIGN PATENT DOCUMENTS

JP 60-024841 A 2/1985

(Continued)

OTHER PUBLICATIONS

Korean Examination Report dated Sep. 9, 2006.

(Continued)

*Primary Examiner*—Justine R Yu
*Assistant Examiner*—Annette F Dixon
(74) *Attorney, Agent, or Firm*—Cheng Law Group PLLC

(57) ABSTRACT

A massage machine is provided, which can efficiently create a massage program to meet the user's preference by reflecting a change in massage parameter performed during an execution of the massage program on the next execution of the massage program. This massage machine comprises an input unit configured to input the change in massage parameter, first memory for temporarily storing the change in massage parameter input by the input unit in a desired massage stage during the execution of the massage program, second memory for storing the change in massage parameter provided from the first memory after the completion of the massage program, and a control unit configured to modify the desired massage stage according to the change in massage parameter stored in the second memory at the next execution of the massage program.

8 Claims, 7 Drawing Sheets

U.S. PATENT DOCUMENTS

| | | | | |
|---|---|---|---|---|
| 4,422,449 | A * | 12/1983 | Hamabe | 601/99 |
| 4,576,149 | A | 3/1986 | Otuka et al. | |
| 6,171,266 | B1 * | 1/2001 | Inada et al. | 601/99 |
| 6,290,661 | B1 * | 9/2001 | Cutler et al. | 601/49 |
| 6,375,630 | B1 * | 4/2002 | Cutler et al. | 601/57 |
| 7,429,251 | B2 * | 9/2008 | Tanizawa et al. | 601/94 |
| 2002/0068887 | A1 * | 6/2002 | Kikumoto et al. | 601/49 |
| 2004/0243030 | A1 * | 12/2004 | Tanizawa et al. | 601/90 |
| 2006/0217642 | A1 * | 9/2006 | Tanizawa et al. | 601/98 |
| 2008/0097260 | A1 * | 4/2008 | Tsukada et al. | 601/98 |

FOREIGN PATENT DOCUMENTS

| | | |
|---|---|---|
| JP | 06-327739 | 11/1994 |
| JP | 7-323066 | 12/1995 |
| JP | 11-099188 | 4/1999 |
| JP | 2001-104425 | 4/2001 |
| JP | 2001-190620 | 7/2001 |
| JP | 2002-369853 | 12/2002 |
| JP | 2002-369854 A | 12/2002 |
| JP | 2003-024400 | 1/2003 |
| KR | 1998-079933 | 11/1998 |

International Search Report.

Notification of Reasons for Refusal for the Application No. 2003-117504 from Japan Patent Office mailed Jul. 22, 2008.

* cited by examiner

FIG. 3

| Massage stage No. | The kind of massage action | Action ranges of massage heads | | The number of massage actions | Massage strength | Massage speed |
|---|---|---|---|---|---|---|
| | | Width direction | Height direction | | | |
| 1 | acupressure | W3 | H4 | 2 | 3 | 3 |
| 2 | tapping | W5 | H4 | 2 | 3 | 3 |
| 3 | kneading up | W1 | H2 | 2 | 3 | 3 |
| 4 | kneading down | W1 | H4 | 2 | 3 | 3 |
| 5 | acupressure | W3 | H4 | 2 | 3 | 3 |
| 6 | acupressure | W1 | H6 | 2 | 3 | 3 |
| 7 | kneading down | W5 | H4 | 2 | 3 | 3 |
| 8 | kneading up | W1 | H10 | 2 | 3 | 3 |
| 9 | tapping | W3 | H10 | 2 | 3 | 3 |
| 10 | kneading up | W1 | H12 | 2 | 3 | 3 |

FIG. 6

| Massage stage No. | The kind of massage action | Action ranges of massage heads | | The number of massage actions | Massage strength | Massage speed |
|---|---|---|---|---|---|---|
| | | Width direction | Height direction | | | |
| 1 | acupressure | W3 | H4 | 3 | 3 | 3 |
| 2 | tapping | W5 | H4 | 2 | 3 | 3 |
| 3 | kneading up | W1 | H2 | 2 | 3 | 3 |
| 4 | kneading down | W1 | H4 | 2 | 3 | 3 |
| 5 | acupressure | W3 | H4 | 3 | 3 | 3 |
| 6 | acupressure | W1 | H6 | 2 | 3 | 3 |
| 7 | kneading down | W5 | H4 | 2 | 3 | 3 |
| 8 | kneading up | W1 | H10 | 2 | 3 | 3 |
| 9 | tapping | W3 | H10 | 2 | 3 | 3 |
| 10 | kneading up | W1 | H12 | 2 | 3 | 3 |

FIG. 7A

| Massage stage No. | The kind of massage action | Action ranges of massage heads | | The number of massage actions | Massage strength | Massage speed |
|---|---|---|---|---|---|---|
| | | Width direction | Height direction | | | |
| 1 | acupressure | W3 | H4 | 2 | 3 | 3 |
| 2 | tapping | W5 | H4 | 2 | 3 | 3 |
| 3 | kneading up | W1 | H2 | 3 | 3 | 3 |
| 4 | kneading down | W1 | H4 | 3 | 3 | 3 |
| 5 | acupressure | W3 | H4 | 2 | 3 | 3 |
| 6 | acupressure | W1 | H6 | 2 | 3 | 3 |
| 7 | kneading down | W5 | H4 | 2 | 3 | 3 |
| 8 | kneading up | W1 | H10 | 2 | 3 | 3 |
| 9 | tapping | W3 | H10 | 3 | 3 | 3 |
| 10 | kneading up | W1 | H12 | 2 | 3 | 3 |

FIG. 7B

| Memory No. | The kind of massage action | Action ranges of massage heads | |
|---|---|---|---|
| | | Width direction | Height direction |
| 1 | kneading up | W1 | H2 |
| 2 | kneading down | W1 | H4 |
| 3 | tapping | W3 | H10 |

FIG. 8A

| Massage stage No. | The kind of massage action | Action ranges of massage heads | | The number of massage actions | Massage strength | Massage speed |
|---|---|---|---|---|---|---|
| | | Width direction | Height direction | | | |
| 1 | acupressure | W3 | H4 | 2 | 3 | 3 |
| 2 | tapping | W5 | H4 | 2 | 3 | 3 |
| 3 | kneading up | W1 | H2 | 2 | 3 | 3 |
| 4 | kneading down | W1 | H4 | 3 | 3 | 3 |
| 5 | acupressure | W3 | H4 | 2 | 3 | 3 |
| 6 | acupressure | W1 | H6 | 3 | 3 | 3 |
| 7 | kneading down | W5 | H4 | 2 | 3 | 3 |
| 8 | kneading up | W1 | H10 | 2 | 3 | 3 |
| 9 | tapping | W3 | H10 | 3 | 3 | 3 |
| 10 | kneading up | W1 | H12 | 2 | 3 | 3 |

FIG. 8B

| Memory No. | The kind of massage action | Action ranges of massage heads | |
|---|---|---|---|
| | | Width direction | Height direction |
| 1 | kneading down | W1 | H4 |
| 2 | tapping | W3 | H10 |
| 3 | acupressure | W1 | H6 |

FIG. 10

| Massage stage No. | The kind of massage action | Block No. | The number of massage actions | Massage strength | Massage speed |
|---|---|---|---|---|---|
| 1 | acupressure | B8 | 2 | 3 | 3 |
| 2 | tapping | B14 | 2 | 3 | 3 |
| 3 | kneading up | B1 | 2 | 3 | 3 |
| 4 | kneading down | B2 | 2 | 3 | 3 |
| 5 | acupressure | B8 | 2 | 3 | 3 |
| 6 | acupressure | B3 | 2 | 3 | 3 |
| 7 | kneading down | B14 | 2 | 3 | 3 |
| 8 | kneading up | B5 | 2 | 3 | 3 |
| 9 | tapping | B11 | 2 | 3 | 3 |
| 10 | kneading up | B6 | 2 | 3 | 3 |

MASSAGE PROGRAM CONTROL METHOD, MASSAGE MACHINE USING THE METHOD, AND CONTROLLER FOR THE MASSAGE MACHINE

TECHNICAL FIELD

The present invention relates to a massage machine for providing a massage to a user according to a massage program having a plurality of massage stages with different massage parameters.

BACKGROUND ART

Due to recent developments in control engineering, complex massage actions such as acupressure actions, kneading actions and combinations thereof have become possible in addition to a relatively simple massage action such as tapping. By carrying out these massage actions according to a predetermined program, high massage effects have been obtained, which are comparable to them brought by skilled massage therapists.

For example, as this kind of massage machine, Japanese Patent Early Publication [kokai] No. 6-327739 discloses a chair-type massage machine with an automatic massage course function. This massage machine comprises a repetition unit for ordering the repetition of a desired massage action during an execution of the massage course, and a control unit for performing the massage action ordered by the repetition unit again at that time. As a result, a degree of satisfaction of the user receiving the massage course can be improved by quickly responding to the user's request.

However, in this massage machine, the repetition of the massage action is available only in the executed massage course. Therefore, it is needed to input the order for the repetition of the desired massage action again at the next execution of the massage course. This leads to an inconvenience of forcing the user in a relaxed state by the massage to perform the same input operation every execution of the massage course.

Thus, since the massage course can not be modified to meet the user's preference in consideration of changes made every execution of the massage course, the conventional massage machine still has plenty of room for improvement.

SUMMARY OF THE INVENTION

Therefore, a concern of the present invention achieved for solving the above problem is to provide a massage program control method for modifying a massage program so as to meet a user's preference by reflecting a change in massage parameter performed during an execution of the massage program on the next execution of the massage program.

That is, on the condition of using a massage machine for providing a massage according to a massage program having a plurality of massage stages with different massage parameters, the massage program control method of the present invention is characterized by comprising the steps of storing a change in massage parameter performed in a desired massage stage during an execution of the massage program in a memory, and modifying the desired massage stage according to the change in massage parameter stored in the memory at the next execution of the massage program.

According to the control method of the present invention, since the change in massage parameter performed to meet the user's preference during the execution of a predetermined massage program can be reflected on the subsequently performed massage program, it is possible to modify the contents of the massage program to meet the user's preference, without performing the same operation of changing the massage parameter every execution of the massage program.

In addition, when a change in total time required for the massage program occurs due to the change in massage parameter in the desired massage stage, it is preferred to change a corresponding massage parameter in another massage stage other than the desired massage stage such that the massage program is completed within a predetermined time period.

In this case, even when the massage parameter, for example, the number of actions of a massage applicator is changed in the desired massage stage, the massage program can be always completed within the required time period by adjusting the number of actions of the massage applicator in another massage stage.

Specifically, it is preferred that the memory comprises a memory table for storing a required number of massage stages having a same massage parameter, and when the desired massage stage is stored in the memory table as a result of the change in massage parameter, another massage stage stored in a predetermined position in the memory table is deleted from the memory table, and the massage parameter in the another massage stage deleted from the memory table is changed such that the massage program is completed within a predetermined time period.

As a further preferred embodiment of the present invention, the memory comprises a memory table for storing a required number of massage stages having a same number of massage actions. In this case, when the desired massage stage is stored in the memory table as a result of a change in the number of massage actions in the desired massage stage, another massage stage stored in a predetermined position in the memory table is deleted from the memory table, and the number of massage actions in the another massage stage deleted from the memory table is changed such that the massage program is completed within a predetermined time period.

In addition, it is preferred that the massage program comprises a plurality of massage stages having a same massage parameter, and when a change in massage parameter performed in one of the massage stages having the same massage parameter is stored in the memory, the massage stages having the same massage parameters are modified in one lump according to the change in massage parameter stored in the memory at the next execution of the massage program.

In this case, it is possible to effectively provide the massage program, while keeping the user in a relaxed state, without performing the operation of inputting the change in massage parameter every execution of the massage stage having the same massage parameter.

Specifically, it is preferred that the massage parameter comprises a combination of range of massage action and at least one of the kind of massage action, the number of massage actions, massage strength and massage speed, and the massage program comprises a plurality of massage stages having a same range of massage action. In this case, when a change in massage parameter performed in one of the massage stages having the same range of massage action is stored in the memory, the massage stages having the same range of massage action are modified in one lump according to the change in massage parameter stored in the memory at the next execution of the massage program.

As a further preferred embodiment of the present invention, the massage parameter comprises a combination of range of massage action in a width direction, range of massage action in a height direction, and at least one of the kind of massage action, the number of massage actions, massage strength and massage speed, and the massage program comprises a plurality of massage stages having at least one of a same range of massage action in the width direction and a same range of massage action in the height direction. In this case, when a change in massage parameter performed in one of the plurality of massage stages is stored in the memory, the massage stages having at least one of the same range of massage action in the width direction and the same range of massage action in the height direction are modified in one lump according to the change in massage parameter stored in the memory at the next execution of the massage program.

In addition, it is preferred that the massage parameter comprises range of massage action provided by a plurality of blocks, each of which is composed of a plurality of combinations of range of massage action in a width direction and range of massage action in a height direction. In this case, an optimum block is determined from the plurality of blocks according to a predetermined correlation between the range of massage action and body-type information, and the body-type information of a user to be massaged, and one of the plural combinations of the range of massage action in the width direction and the range of massage action in the height direction is determined in the optimum block to meet the user's preference.

In this invention, it is possible to prevent that the user mistakenly selects a range of massage action considerably deviated from an optimum range of massage action recommended from the body-type information of the user during the execution of the massage program. In addition, a comfortable massage effect can be provided to the user unskilled in the massage machine by a relatively simple operation.

A further concern of the present invention is to provide a massage machine using the control method described above. That is, this massage machine is characterized by comprising an input unit configured to input a change in massage parameter, first memory for temporarily storing the change in massage parameter input by the input unit in a desired massage stage during an execution of a massage program, second memory for storing the change in massage parameter provided from the first memory after the completion of the massage program, and a control unit for modifying the desired massage stage according to the change in massage parameter stored in the second memory at the next execution of the massage program.

Furthermore, another concern of the present invention is to provide a controller for the massage machine. That is, this controller is detachable to a massage machine comprising a first memory for temporarily storing a change in massage parameter in a desired massage stage during an execution of a massage program, second memory for storing the change in massage parameter provided from the first memory after the completion of the massage program, and a control unit for modifying the desired massage stage according to the change in massage parameter stored in the second memory at the next execution of the massage program. The controller is characterized by comprising an input unit configured to input the change in massage parameter, and a screen for displaying the massage parameter.

Additional features of the present invention and effects brought thereby will be understood from the best mode for carrying out the invention described below.

BRIEF EXPLANATION OF THE DRAWINGS

FIG. 3 is an example of a massage program used in the massage machine;

FIG. 6 is a modification result of the massage program of FIG. 3 according to a massage program control method of the present invention;

FIGS. 7A and 7B are respectively another massage program and a memory table available in the present massage machine;

FIGS. 8A and 8B are modification results of the massage program of FIG. 7A and the memory table of FIG. 7B according to another massage program control method of the present invention;

FIG. 10 is an example of the massage program used in the modification.

BEST MODE FOR CARRYING OUT THE INVENTION

Referring to the attached drawings, the present invention is explained in details according to preferred embodiments.

Figure 1:
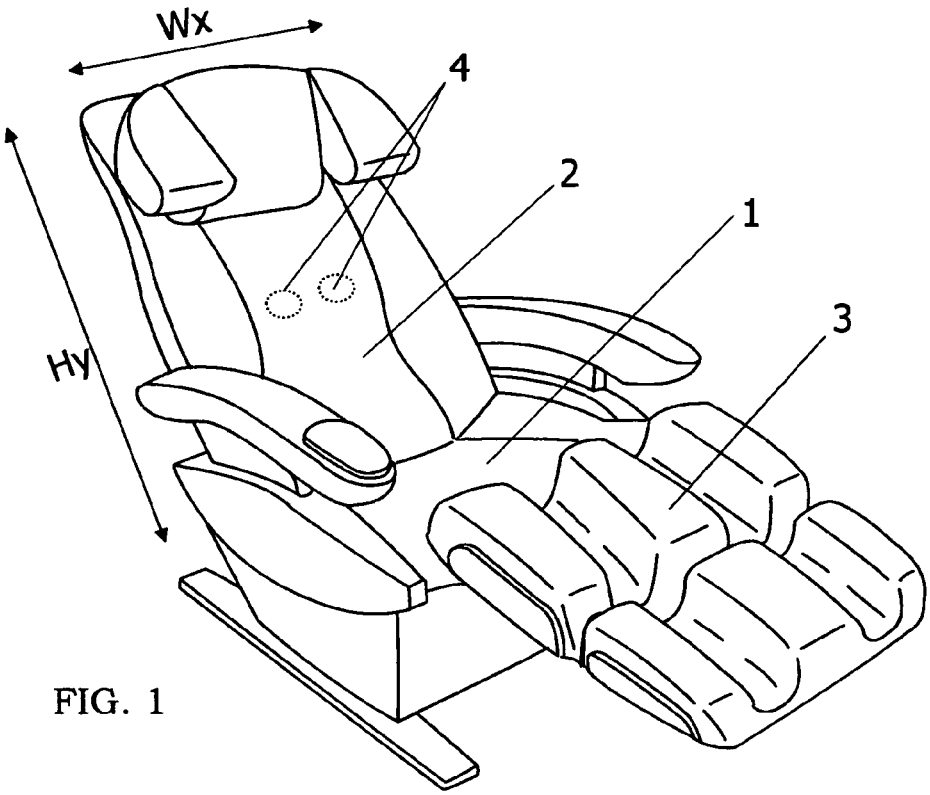
FIG. 1 is a perspective view of a chair-type massage machine according to an embodiment of the present invention.

As shown in FIG. 1, a chair-type massage machine according to an embodiment of the present invention comprises a seat portion 1, backrest portion 2, and a leg support portion 3. Massage heads 4 are incorporated in the backrest portion 2, and can be driven by a drive mechanism (not shown). A structure of the drive mechanism is not limited on the condition that a required massage action can be provided through the massage heads 4. For example, a drive mechanism introduced in Japanese Patent Early Publication No. 6-327739 may be used. In this embodiment, the drive mechanism is configured such that any one of an acupressure action, tapping action, kneading-up action and a kneading-down action can be selectively provided to the back of a user sitting on the seat portion 1 through the massage heads 4.

Figure 2:
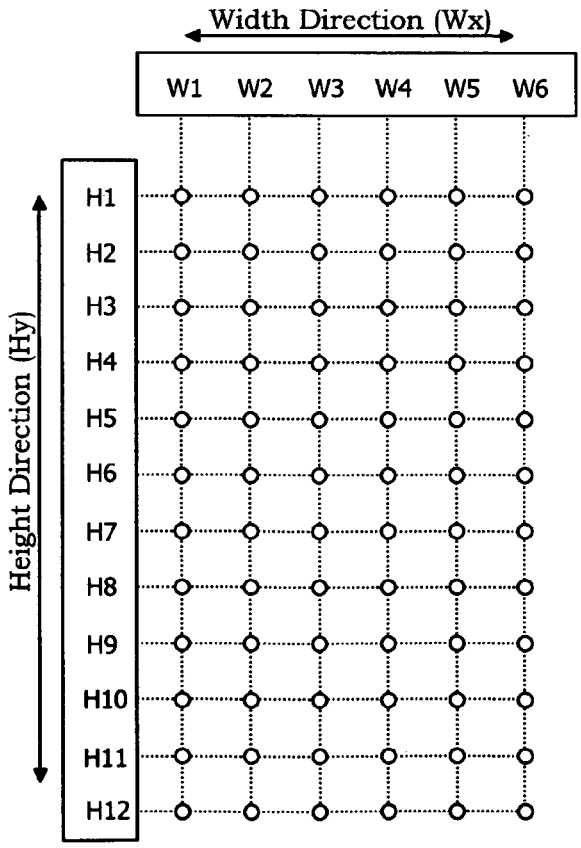
FIG. 2 is an explanatory view for an action range of a massage head of the massage machine.

In the massage machine of this embodiment, as shown in FIG. 2, a desired action range (Wx, Hy) of the massage heads 4 can be selected from total 72 (6×12) different action ranges. That is, the desired action range is determined by a combination of one of a plurality of action ranges (Wx, x=1 to 6) of the massage heads 4 in a width direction W of the backrest portion 2 and one of a plurality of action ranges (Hy=1 to 12) of the massage heads 4 in a height (up and down) direction H of the backrest portion 2. In this embodiment, as the values (x, y) become larger, a larger action range of the massage heads 4 is obtained.

In the massage machine of this embodiment, the number of massage actions, a magnitude of load applied to the user through the massage heads 4 (hereinafter referred to "massage strength"), and massage speed can be changed as the massage parameter as well as the kind of massage action provided by the massage heads 4 and the action range (Wx, Hy) of massage (the massage heads).

In the massage machine of the present embodiment, a massage program for providing a plurality of massage stage with different massage parameters in a predetermined order to the user is installed. The motion of the massage heads 4 based on this massage program is controlled by a control unit described later of the massage machine.

FIG. 3 shows an example of the massage program. This massage program has 10 massage stages. Each of the massage stages is different from an adjacent massage stage by one of the kind of massage action provided by the massage heads 4 and the ranges of massage action (Wx, Hy). In this case, the number of massage action (2 times), massage strength (Level 3) and the massage speed (Level 3) are respectively constant.

Figure 4:
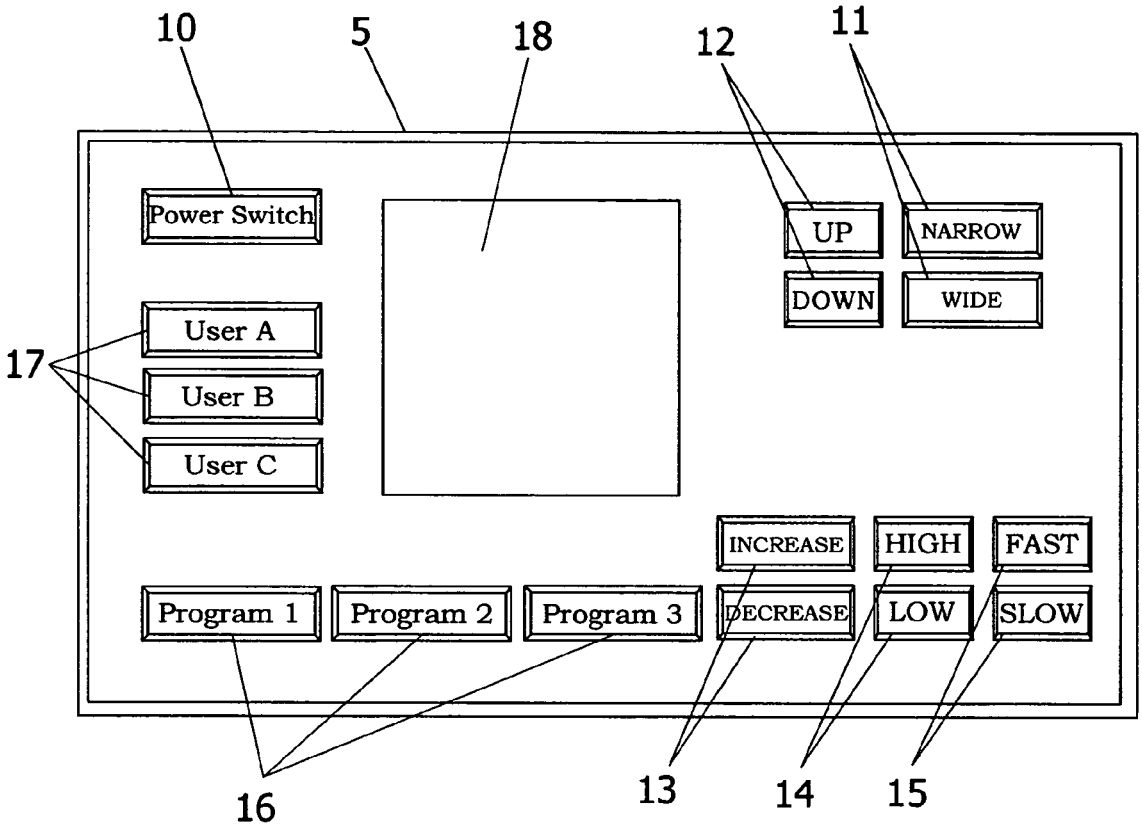
FIG. 4 is a front view of a controller for the massage machine.

An input for changing the massage parameter can be performed through a controller for the massage machine shown in FIG. 4. This controller 5 is detachable to a main body of the massage machine, and comprises a main power switch 10, buttons 11 for changing the action range (Wx) of the massage heads 4 in the width direction, buttons 12 for changing the action range (Hy) of the massage heads 4 in the height direction, buttons 13 for changing the number of massage actions, buttons 14 for changing the massage strength, buttons 15 for changing the massage speed, buttons 16 for selecting the massage program, user identification buttons 17 for reading out the massage program stored in association with the individual user, and a display 18 for displaying the contents of the massage program. The controller of FIG. 4 is an example. If necessary, the number of buttons for changing the massage parameters may be reduced, or buttons for changing another massage parameter such as the kind of the massage action provided by the massage heads 4 may be added.

Figure 5:
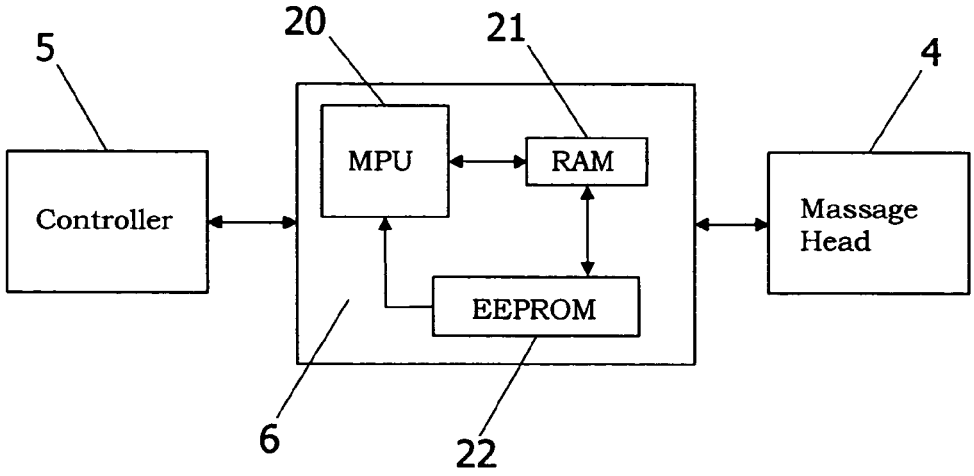
FIG. 5 is a block diagram of a control unit of the massage machine.

As shown in FIG. 5, the control unit 6 of the massage machine of this embodiment comprises a processor 20 composed of MPU and a memory provided with RAM 21 and EEPROM 22. During the execution of the massage program, when a change in massage parameter is input from the controller 5 in a desired massage stage, it is temporarily stored in the RAM 21. According to the change in massage parameter performed during the execution of the massage program, the massage program in progress is changed, and the information about the change in the massage parameter stored in the RAM is stored in the EEPROM 22. When the massage program is performed next time, the control unit 6 modifies the massage program according to the information about the change in massage parameter stored in the EEPROM 22. Therefore, the user is only needed to push the user identification button 17 to select the massage program for the user, so that a modified massage program based on the change in massage parameter performed last time is provided to the user. In addition, when the above operation of changing the massage parameter is performed plural times, it is possible to efficiently obtain the massage program to meet the user's preference.

When the user changes a massage parameter in the desired massage stage, the massage machine of this embodiment has a function of changing the massage parameter in one lump with respect to the desired massage stage and another massage stage(s) having the same massage parameter at the next execution of the massage program.

For example, when the number of massage actions in the massage stage No. 1 is changed from 2 times to 3 times during the execution of the massage program of FIG. 3 by use of the massage machine, the number of massage actions in the massage stage No. 5, which has the same action range (W3, H4) of the massage heads and the same kind of massage action (acupressure) as them of the massage stage No. 1, is also changed from 2 times to 3 times in one lump. A modified massage program obtained by modifying the massage program of FIG. 3 according to this control method is shown in FIG. 6.

In addition, when at least one of the action range of the massage heads and the kind of massage action in another massage stage is equal to the massage parameter of the massage stage No. 1, the another massage stage may be modified in one lump. The massage parameter other than the number of massage actions can be changed in one lump in a similar manner to the above. By the way, the present control method is characterized by changing the massage parameter in one lump at the next execution of the massage program according to the change in massage parameter performed in the last execution of the massage program. Alternatively, the massage stages of the massage program in progress may be modified in one lump.

By using the above function, it is not needed for the user to change the massage parameter every execution of the massage stage having the same or similar massage parameter. Therefore, the user can receive the massage program under a more relaxed condition. As a result, there is an advantage that the massage program can be more effectively provided to the user.

In addition, when an increase or decrease in total time required for the massage program is caused by the change in massage parameter, the massage machine of the present embodiment has a function of automatically adjusting the massage program such that the massage program is completed within a predetermined time period.

The following explanation is useful to understand this control function. For example, a massage program shown in FIG. 7A is set, and a memory table having the capability of storing three massage stages at the maximum is formed, as shown in FIG. 7B. On the condition that the number of massage actions is 3 times, only the kind of massage action and the ranges of massage actions are stored in the memory table. That is, in the memory table of FIG. 7, the massage stage No. 1 is stored in the memory No. 1, the massage stage No. 4 is stored in the memory No. 2, and the massage stage No. 9 is stored in the memory No. 3.

For example, as shown in FIG. 8A, when the user changes the number of massage actions in the massage stage No. 6 from 2 times to 3 times, it means that the time period needed to complete the massage program is extended by an increase in the total number of the massage stages having the number of massage actions (3 times). In this case, as shown in FIG. 8A, the control unit deletes the massage stage No. 3 stored in the memory No. 1 from the memory table, and also decreases the number of massage actions in the massage stage No. 3 from 3 times to 2 times. In addition, the massage stages No. 4 and No. 9 are respectively moved forward to the memory No. 1 and No. 2, and stored therein. On the other hand, the massage stage No. 6 having the changed massage parameter, i.e., the number (3 times) of massage actions, is newly stored in the memory No. 3 of the memory table.

Thus, the change in massage parameter is deleted in order of occurrence, and the total number of the massage stages with an increase in the number of massage actions is limited. In addition, the number of massage actions changeable in each of the massage stages is also limited. Therefore, even when the user increases the number of massage actions in the desired massage stage during the execution of the massage program, the total time required to complete the massage program can be maintained in a predetermined time period by decreasing the number of massage actions in another massage stage. Of course, when the user decreases the number of massage action in the desired massage stage of the massage program, the total time required to complete the massage program can be maintained in the predetermined time period by increasing the number of massage actions in another massage stage.

In the past, it has been proposed to monitor the execution time of the massage program by use of a timer, and forcedly finish the massage program when the execution time reaches a predetermined time period. However, in such a control method, there is a fear that the massage program in progress is stopped on the way as a result of a change in massage parameter before the completion of the final massage stage. In this case, a comfortable massage effect can not be sufficiently achieved. On the contrary, according to the control method of the present invention, even when the massage parameter is changed, it is possible to complete the massage program within the required time period, and therefore stably provide the comfortable massage program to the user.

As a modification of the massage machine of this embodiment, it is preferred that an optimum one of a plurality of combinations of the range of massage action in the width direction and the range of massage action in the height direction can be selected according to an input of body-type information peculiar to the user.

Figure 9:
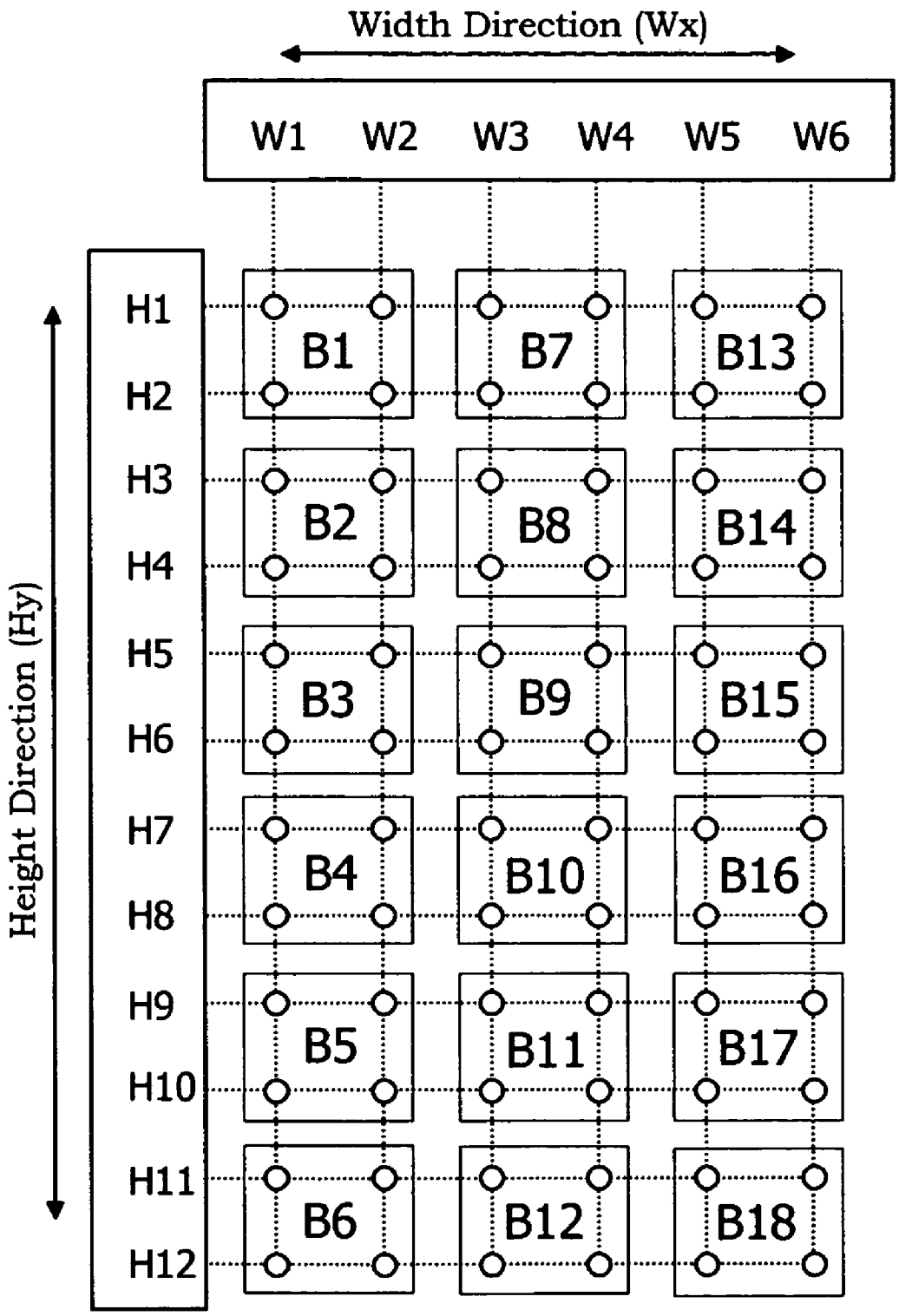
FIG. 9 is a diagram showing a modification of the massage machine of the above embodiment.

For example, as shown in FIG. 9, 18 blocks (B1 to B18) are provided, each of which is composed of a set of four different action ranges (Wx, Hy) of the massage heads 4 of FIG. 2. Based on a previously prepared correlation between the action range of the massage heads and the body-type information such as body height and body weight, and the body-type information of the user to be massaged, a recommended block is determined from the 18 blocks in each of the massage stages, and displayed on the display 18 of the controller 5. Next, a favorite one of the four action ranges (Wx, Hy) in the recommended block is selected by the user. Therefore, it is possible to avoid a situation that the user mistakenly selects the massage action that is not adequate for the user during the execution of the massage program. FIG. 10 is an example of the massage program having recommended blocks for the respective massage stages.

In the case of inputting the body-type information of the user, a body-height input portion (not shown) for inputting a body height of the user may be formed in the controller. Alternatively, the body-type information of the user may be collected by setting positions of the massage heads at the shoulder position of the user sitting on the massage machine, and then pushing a reset button (not shown).

INDUSTRIAL APPLICABILITY

As described above, according to the present invention, since the massage program can be modified to meet the user's preference by reflecting a change in massage parameter input during an execution of the massage program on the next execution of the massage program, it is possible to provide a more comfortable massage effect to an individual user, as compared with the case of repeatedly providing a predetermined massage program. In addition, it is not needed to change the massage parameter every execution of the massage program. Therefore, even when the user is senior citizen or not be good at operating the massage machine, there is an advantage that a desired massage effect can be readily obtained without a complex setting operation.

The invention claimed is:

1. A method of controlling a massage program having a plurality of massage stages with different massage parameters in a massage machine for providing a massage according to said massage program, said method comprising the steps of storing a change in massage parameter performed in a desired massage stage during an execution of said massage program in a memory, and modifying the desired massage stage according to the change in massage parameter stored in said memory at the next execution of said massage program, wherein when a change in total time required for said massage program occurs due to the change in massage parameter in the desired massage stage, the massage parameter of another massage stage corresponding to the massage parameter changed in the desired massage parameter is changed such that said massage program is completed within a predetermined time period, wherein said memory comprises a memory table for storing a required number of massage stages having a same massage parameter, and when the desired massage stage is stored in said memory table as a result of the change in massage parameter, another massage stage stored at a predetermined position in said memory table is deleted from said memory table, and the massage parameter of said another massage stage deleted from said memory table is changed such that said massage program is completed within a predetermined time period, and wherein said method utilizes an input unit configured to input the change in the massage parameter during the execution of the massage program, and said massage program being configured to acknowledge the change in the massage parameter made through the input unit during the execution of the massage program, modify the individual massage parameter reflecting the change, and store thus modified massage parameter in the memory.

2. The method as set forth in claim 1, wherein said massage machine is a chair-type massage machine having a backrest portion, in which a massage head for providing a massage action is incorporated, and said massage parameters comprises the kind of massage action, range of massage action, the number of massage actions, massage strength and massage speed.

3. The method as set forth in claim 2, wherein the required number of massage stages having the same massage parameter stored in said memory table is a required number of massage stages having a same number of massage actions, and when the desired massage stage is stored in said memory table as a result of the change in the number of massage actions, another massage stage stored at a predetermined position in said memory table is deleted from said memory table, and the number of massage actions of said another massage stage deleted from said memory table is changed such that said massage program is completed within a predetermined time period.

4. A method of controlling a massage program having a plurality of massage stages with different massage parameters in a massage machine for providing a massage according to said massage program, said method comprising the steps of storing a change in massage parameter performed in a desired massage stage during an execution of said massage program in a memory, and modifying the desired massage stage according to the change in massage parameter stored in said memory at the next execution of said massage program, wherein the massage parameter comprises a combination of range of massage action and at least one of the kind of massage action, the number of massage actions, massage strength and massage speed, said massage program comprises a plurality of massage stages having a same range of massage action, and when a change in massage parameter performed in one of the massage stages having the same range of massage action is stored in said memory, the massage stages having the same range of massage action are modified in one lump according to the change in massage parameter stored in said memory at the next execution of said massage program, wherein the range of massage action is a combination of ranges of massage action in width and height directions, said plurality of massage stages have at least one of a same range of massage action in the width direction and a same range of massage action in the height direction, and when a change in massage parameter performed in one of the massage stages is stored in said memory, the massage stages having at least one of the same range of massage action in the width direction and the same range of massage action in the height direction are modified in one lump according to the change in massage parameter stored in said memory at the next execution of said massage program, and wherein said method utilizes an input unit configured to input the change in the massage parameter during the execution of the massage program, and said massage program being configured to acknowledge the change in the massage parameter made through the input unit during the execution of the massage program, modify the individual massage parameter reflecting the change, and store thus modified massage parameter in the memory.

5. A method of controlling a massage program having a plurality of massage stages with different massage parameters in a massage machine for providing a massage according to said massage program, said method comprising the steps of storing a change in massage parameter performed in a desired massage stage during an execution of said massage program in a memory, and modifying the desired massage stage according to the change in massage parameter stored in said memory at the next execution of said massage program, wherein said massage parameter comprises range of massage action provided by a plurality of blocks, each of which is composed of plural combinations of range of massage action in a width direction and range of massage action in a height direction, wherein an optimum block is determined from said blocks by comparing a previously prepared correlation between the range of massage action and body information including body weight and body height, with the body information of a user to be massaged; and one of the plural combinations of the range of massage action in the width direction and the range of massage action in the height direction is determined in said optimum block to meet the user's preference, and wherein said method utilizes an input unit configured to input the change in the massage parameter during the execution of the massage program, and said massage program being configured to acknowledge the change in the massage parameter made through the input unit during the execution of the massage program, modify the individual massage parameter reflecting the change, and store thus modified massage parameter in the memory.

6. A massage machine for providing a massage according to a massage program having a plurality of massage stages with different massage parameters, said massage machine comprising:

an input unit configured to input a change in massage parameter during the execution of the massage program;

a first memory for temporarily storing the change in massage parameter input by said input unit in a desired massage stage during an execution of said massage program;

a second memory for storing the change in massage parameter provided from said first memory after the completion of said massage program; and a control unit configured to control the massage program according to the method as set forth in claim 1, and to acknowledge the change in the massage parameter made through the input unit during the execution of the massage program, modify the individual massage parameter reflecting the change, and store thus modified massage parameter in the second memory.

7. The massage machine as set forth in claim 6, wherein the massage machine is a chair-type massage machine having a backrest portion, in which a massage head for providing a massage action is incorporated.

8. A controller for a massage machine for providing a massage according to a massage program having a plurality of massage stages with different massage parameters, said massage machine comprising:

a first memory for temporarily storing a change in massage parameter performed in a desired massage stage during an execution of said massage program;

a second memory for storing the change in massage parameter provided from said first memory after the completion of said massage program; and a control unit configured to control the massage program according to the method as set forth in claim 1, wherein the controller is detachable to the massage machine, and comprises an input unit configured to input the change in the massage parameter during the execution of the massage program, and a screen for displaying the massage parameter, and wherein said massage program is configured to acknowledge the change in the massage parameter made through the input unit during the execution of the massage program, modify the individual massage parameter reflecting the change, and store thus modified massage parameter in the memory.

* * * * *